US008725761B2

(12) United States Patent
Rout

(10) Patent No.: US 8,725,761 B2
(45) Date of Patent: May 13, 2014

(54) CHAINAGE CALCULATION METHODOLOGY AND SYSTEM

(75) Inventor: Ranjan Rout, Irving, TX (US)

(73) Assignee: New York Air Brake Corporation, Watertown, NY (US)

( * ) Notice: Subject to any disclaimer, the term of this patent is extended or adjusted under 35 U.S.C. 154(b) by 232 days.

(21) Appl. No.: 13/162,306

(22) Filed: Jun. 16, 2011

(65) Prior Publication Data

US 2012/0323957 A1 Dec. 20, 2012

(51) Int. Cl.
*G06F 17/30* (2006.01)

(52) U.S. Cl.
USPC ..... 707/769; 707/800

(58) Field of Classification Search
USPC ..... 707/800, 769
See application file for complete search history.

(56) References Cited

U.S. PATENT DOCUMENTS

| | | | | |
|---|---|---|---|---|
| 2007/0219682 | A1 | 9/2007 | Kumar et al. | |
| 2008/0021628 | A1 * | 1/2008 | Tryon | 701/99 |
| 2008/0033605 | A1 * | 2/2008 | Daum et al. | 701/19 |
| 2008/0195269 | A1 | 8/2008 | Lacy et al. | |

OTHER PUBLICATIONS

Notification of Transmittal of the International Search Report and the Written Opinion of the International Searching Authority, or the Declaration for PCT/US2012/38391, May 17, 2012.
Written Opinion of the International Searching Authority for International Patent Application No. PCT/US2012/38391, May 17, 2012.

* cited by examiner

*Primary Examiner* — Rehana Perveen
*Assistant Examiner* — Alexander Khong
(74) *Attorney, Agent, or Firm* — Barnes & Thornburg LLP

(57) ABSTRACT

Disclosed embodiments provide a methodology and architecture for calculating the chainage distance using two Positive Train Control (PTC) system messages (e.g., Train Route and Current Position) provided by the PTC system.

24 Claims, 8 Drawing Sheets

Train Route Message 200

| | Field | Size (Bytes) | Type | Description |
|---|---|---|---|---|
| 1 | Switch Count | 1 | Numeric(0-255) | Entries 1a through 1e are repeated 'Switch Count' times |
| 1a | Subdivision ID | 4 | Numeric | |
| 1b | Switch ID | 4 | Numeric | |
| 1c | Previous Track Segment Connection | 1 | Enumeration | |
| 1d | Next Track Segment Connection | 1 | Enumeration | |
| 1e | Alignment | 1 | Enumeration | |
| 2 | Track Segment Count | 1 | Numeric | Entries 2a through 2f are repeated for each track segment |
| 2a | Subdivision ID | 4 | Numeric | |
| 2b | Track Segment ID | 4 | Numeric | |
| 2c | Increasing | 1 | Enumeration | 0 = Segment Sequence in direction of decreasing MP<br>1 = Segment Sequence in direction of Increasing MP |
| 2d | Length | 4 | Numeric | Length of track segment (feet) |
| 2e | Prev Switch Index | 1 | Numeric | 255 if not connected to switch |
| 2f | Next Switch Index | 1 | Numeric | 255 if not connected to switch |

210

205

215

220

225

FIGURE 2

PTC Current Position Message 300

| | Field | Size (Bytes) | Type | Description |
|---|---|---|---|---|
| 1 | Subdivision ID | 4 | Numeric | 0 = Unknown |
| 2 | Track Segment ID | 4 | Numeric | 0 = Unknown |
| 3 | Offset into Track Segment | 4 | Numeric | Feet into Track Segment<br>0 = Unknown |
| 4 | Direction of Travel | 1 | Enumeration | 0 = Unknown<br>1 = Decreasing distance from start of Track Segment<br>2 = Increasing distance from start of Track Segment |

305

310

315

320

FIGURE 3

CHAINAGE CALCULATION METHODOLOGY AND SYSTEM

FIELD OF THE INVENTION

Disclosed embodiments are directed, generally, to calculation of a chainage distance in a locomotive train.

DESCRIPTION OF THE RELATED ART

The chainage is the distance of lead locomotive (in feet or meters) from an arbitrary fixed point in the route of the locomotive train. Chainage is utilized to measure, analyze and manage the operation of a locomotive train.

SUMMARY

The following presents a simplified summary in order to provide a basic understanding of some aspects of various disclosed embodiments. The summary is not an extensive overview of the invention. It is neither intended to identify key or critical elements of the invention nor to delineate the scope of the invention. The following summary merely presents some concepts of the disclosed embodiments in a simplified form as a prelude to the more detailed description below.

Disclosed embodiments provide a methodology and architecture for calculating the chainage distance using two Positive Train Control (PTC) system messages (e.g., Train Route and Current Position) provided by the PTC system.

BRIEF DESCRIPTION OF THE DRAWINGS

A more compete understanding of the present invention and the utility thereof may be acquired by referring to the following description in consideration of the accompanying drawings, in which like reference numbers indicate like features, and wherein:

FIG. 2 illustrates a standard format for a Train Route message.

FIG. 3 illustrates a standard format for a Current Position message.

DETAILED DESCRIPTION

The description of specific embodiments is not intended to be limiting of the present invention. To the contrary, those skilled in the art should appreciate that there are numerous variations and equivalents that may be employed without departing from the scope of the present invention. Those equivalents and variations are intended to be encompassed by the disclosed embodiments.

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the disclosed embodiments.

Positive Train Control (PTC) refers to conventionally known technology that is designed to prevent train-to-train collisions, overspeed derailments, casualties or injuries to roadway workers operating within their limits of authority as a result of unauthorized incursion by a train as well as prevent train movements through a switch left in the wrong position. Although PTC systems vary widely in complexity and sophistication based on the level of automation and functionality they implement, the system architecture utilized and the degree of train control they are capable of assuming, PTC systems are consistent in that they are processor-based signal and train control systems (see Title 49 Code of Federal Regulations (CFR) Part 236, Subpart H) that utilize both computers and radio data links to accomplish PTC functions, e.g., monitoring and controlling train movements to provide increased safety.

More specifically, PTC requires that a train receives information about its location and where it is allowed to safely travel, i.e., "movement authorities." Equipment on board the train enforces these movement authorities thereby preventing unsafe movement. PTC systems use Global Positioning System (GPS) navigation to track train movements. Thus, PTC is meant to provide train separation or collision avoidance, line speed enforcement, temporary speed restrictions and ensure rail worker wayside safety.

However, various other benefits may be achieved by use of PTC; for example, the information obtained and analyzed by PTC systems can enable on-board and off-board systems to control the train and constituent locomotives to increase fuel efficiency and to perform locomotive diagnostics for improved maintenance. Because the data utilized by the PTC system is transmitted wirelessly, other applications can use the data as well.

Figure 1:
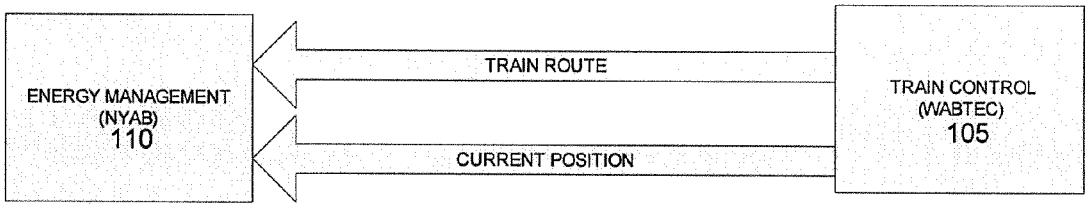
FIG. 1 illustrates the combined train intelligence of a PTC system module and an Energy Management Module (EMM).

Thus, as illustrated in FIG. 1, a PTC system module 105, such as that manufactured by WABTEC (headquartered in Wilmerding, Pa.), has the ability to generate a variety of messages for input into an Energy Management Module (EMM) 110, such as that developed by New York Air Brake (NYAB) of Watertown, N.Y. Such messages include information and data relating to route of a locomotive train 115 as well as current position 120 of the locomotive train on that route.

PTC system module 105 may include hardware, software, firmware or some combination thereof that provide at least two components: one component that provides the speed display and the control unit on the locomotive and one component that dynamically informs the speed control unit of changing track or signal conditions. PTC systems may also include additional components such as an on board navigation system and track profile database utilized to enforce fixed speed limits along a train route, a bi-directional data communication link configured to inform signaling equipment of the train's presence, and centralized systems that are configured to directly issue movement authorities to trains.

Utilizing information and data messages generated by the PTC system module 105 the EMM 110 can determine chainage distance in a manner that is more efficient and effective than would be conventionally possible. More specifically, the Train Route message (denoted as 0531) 200 provides track segment lists for a specified distance in front of and in back of the train, e.g., 8 miles in front and 8 miles behind the train. As shown in FIG. 2, that Train Route message 200 includes various relevant fields including Track Segment Count field 205, Subdivision ID field 210, Track Segment ID field 215, Increasing Flag 220 and Length of Segment field 225. The Track Segment Count field 205 which defines number track segments in the Train Route message. The Subdivision ID field 210 which identifies a PTC subdivision. The Track Segment ID field 215 which identifies a PTC track segment, The Increasing flag 220 which indicates whether the Mile Posts are increasing or decreasing in the track segment for the current direction of travel (1=Increasing MP, 0=Decreasing MP). The Length of segment field 225 which defines length of track segment.

The Current Position message (0530) provides the absolute position of the train head end in terms of a stored track database (accessible via the EMM or other on-board or off board memory access. As shown in FIG. 3, the Current Position message (denoted as 0530) 300 similarly includes various data and informational fields including a Subdivision ID field 305, a Track Segment ID field 310, an Offset into Track Segment field 315, and a Direction of Travel field 320. The Subdivision ID field 305 which identifies a PTC subdivision. The Track Segment ID field 310 which identifies a PTC track segment. The Offset into Track Segment field 315 which indicates distance in feet from lower MP of segment (which is the start of segment). The Direction of Travel field 320 which indicates whether the train is going away from the start of the segment or going towards the start of the segment (Increasing (2) or Decreasing (1) distance from start of the segment).

Figure 5:
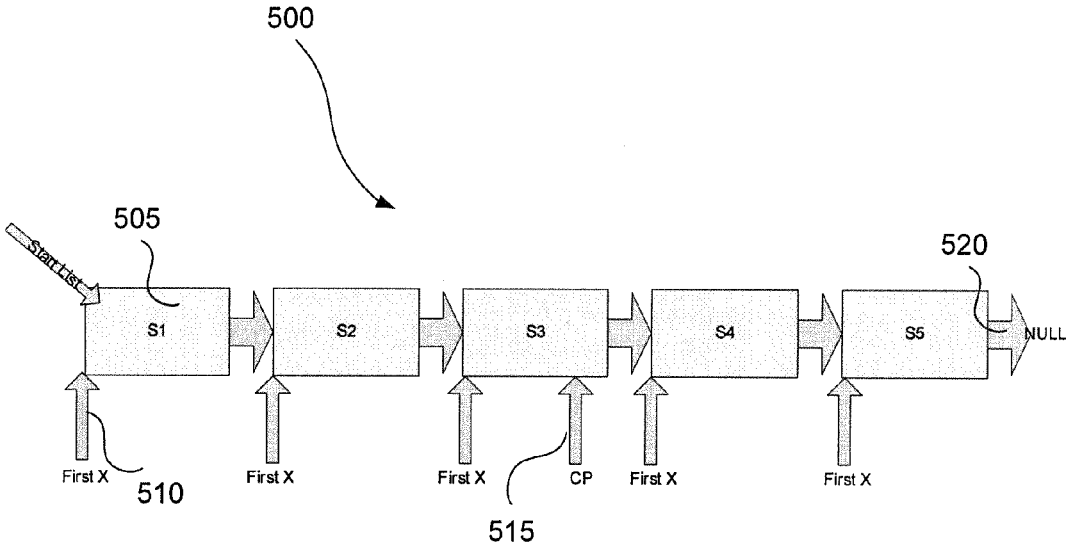
FIG. 5 illustrates an example of a Linked List utilized in conjunction with the disclosed embodiments.

In accordance with the disclosed embodiments, chainage distance may be determined or re-determined every time a train route message is received based on analysis of the Train Route message data in comparison with a Linked List of track segments maintained by the train intelligence. As shown in FIG. 5, for the purpose of chainage distance calculation, each node of the Linked List 500 contains following fields: Subdivision ID field (as explained in conjunction with FIG. 2), Track Segment ID field (as explained in conjunction with FIG. 2), Increasing flag (as explained in conjunction with FIG. 2), Length of Segment field (as explained in conjunction with FIG. 2), and First X of Segment field. The data included in these fields provides the basis for determining the chainage distance.

More specifically, following creation or updating of the Linked List of segments monitoring is performed for new Current Position messages. If it is determined that a Current Position message has been received, the sum of a first X of Segment and offset is designated as the chainage distance (also referred to as an "X Location").

Thus, as shown in FIG. 5, the Linked List 500 includes at least one (and more likely a plurality) of segments 505 associated with track segments along a locomotive train's route. For each segment, a first X location 510 is provided that is associated with the beginning of the track segment. As further shown in FIG. 5, from time to time, Current Position (CP) message 515 may be received by the train intelligence; the data included in that message 515 may be used to perform chainage calculation, as explained in FIGS. 6A-6C. The Linked List of segments ends when no more segments are available (i.e., when a null is registered by the train intelligence signifying no additional segments to analyze).

In this way, every time a Current Position message is received, the sum of First X of segment and offset may be used to determine the X location position. Current position messages are usually sent approximately every 5 seconds and indicate where the head end of the locomotive train is.

As mentioned briefly above, this chainage distance can be used for performing various functions to monitor, manage and optimize energy management behavior by the train intelligence (implemented via hardware and software and including, for example, the EMM 410 illustrated in FIG. 1). Thus, in accordance with at least one disclosed embodiment, energy management behavior may be modeled and managed.

Figure 4:
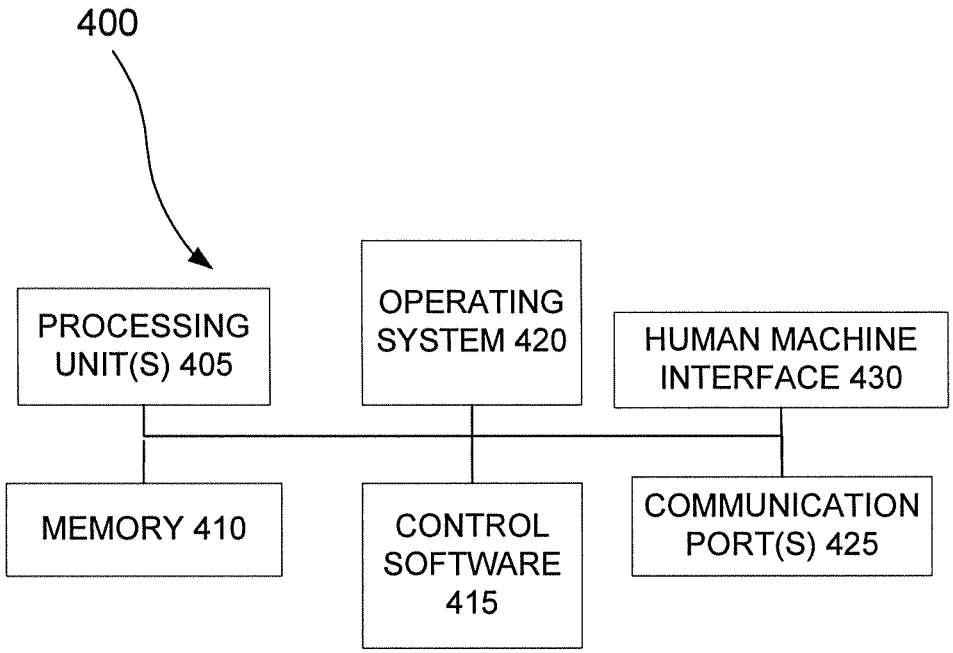
FIG. 4 illustrates one example of the train intelligence that may be used in conjunction with the disclosed embodiments for determination of chainage distance.

Accordingly, to perform these types of operations, the train intelligence provided to perform these operations may include (but is not limited to) the equipment illustrated in FIG. 4. As shown in that figure, the train intelligence 400 may be included in the EMM module 110 (shown in FIG. 1) or vice versa. Regardless of the implementation, the train intelligence 400 may include one or more computer processing units 405 that may be coupled to memory 410 (implemented as one or more conventionally known and commercially available programmable and/or read only or reprogrammable memory devices). The memory 410 may serve to store computer instructions associated with or implementing both control software 415 and optionally an operating system or environment 420 for performing operations included in one or more computer applications, software code packages and/or various called or included subroutines. These instructions may be used to perform the instructions included in the methodologies illustrated in connection with FIGS. 6A-7 to determine chainage distance in a novel way.

Moreover, the train intelligence may also include one or more communication ports 425 that enable both receipt and transmission of messages (such as the messages received from the PTC module of FIG. 1), data and control instructions in accordance with the disclosed embodiments. Furthermore, the train intelligence 400 may include a human machine interface 430 that may include, for example, a display that enables an operator to receive and review data utilized or produced by the train intelligence 400, provide instruction or input direction to the control software 415, access data included in the memory 410, etc. As a result, the human machine interface 430 may also include other conventionally known features including a keyboard, a mouse, a touch pad, various buttons and switches, etc.

Figure 6A:
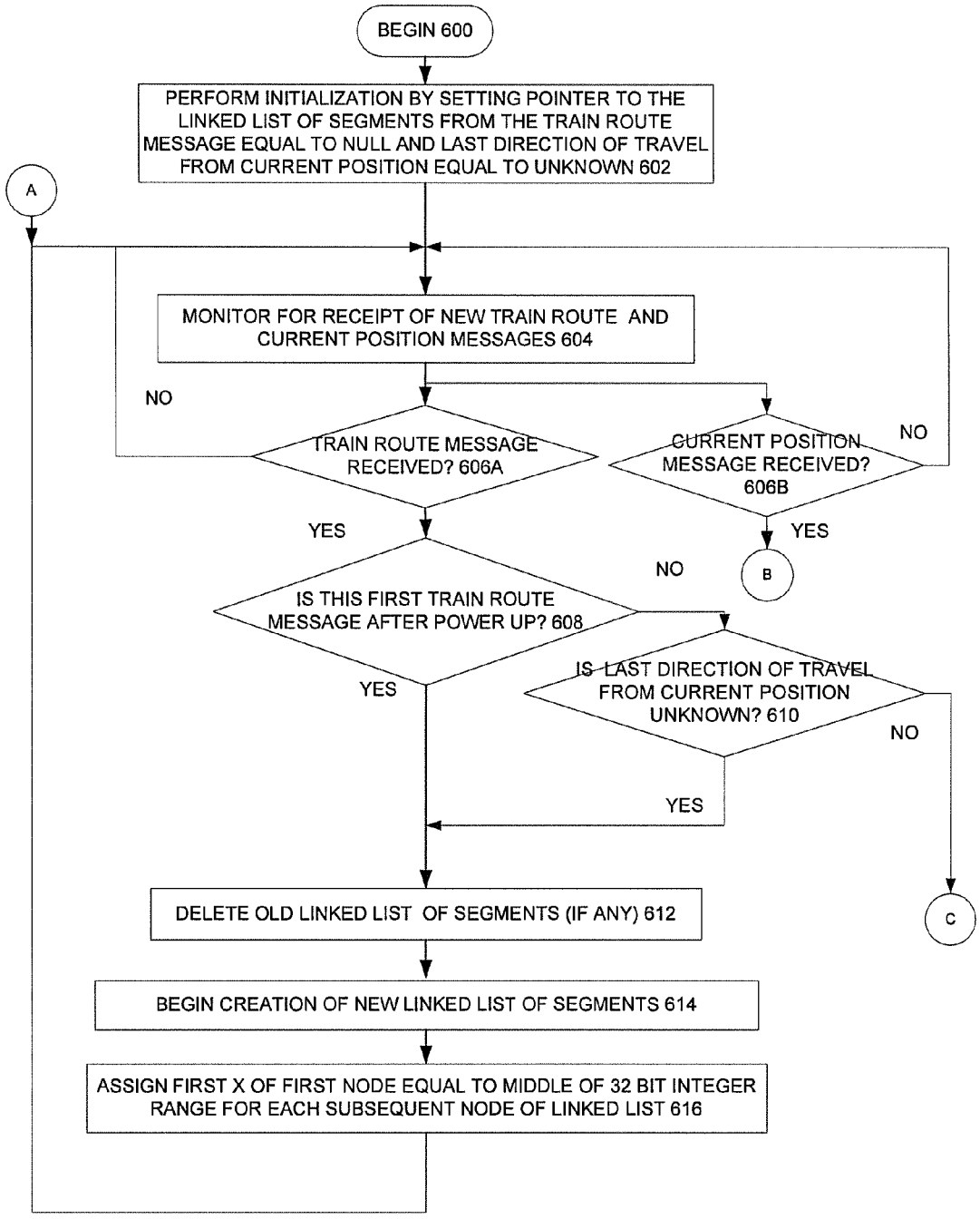
FIGS. 6A-6C illustrate an example of a methodology used to perform chainage calculation in accordance with the disclosed embodiments.
Figure 6B:
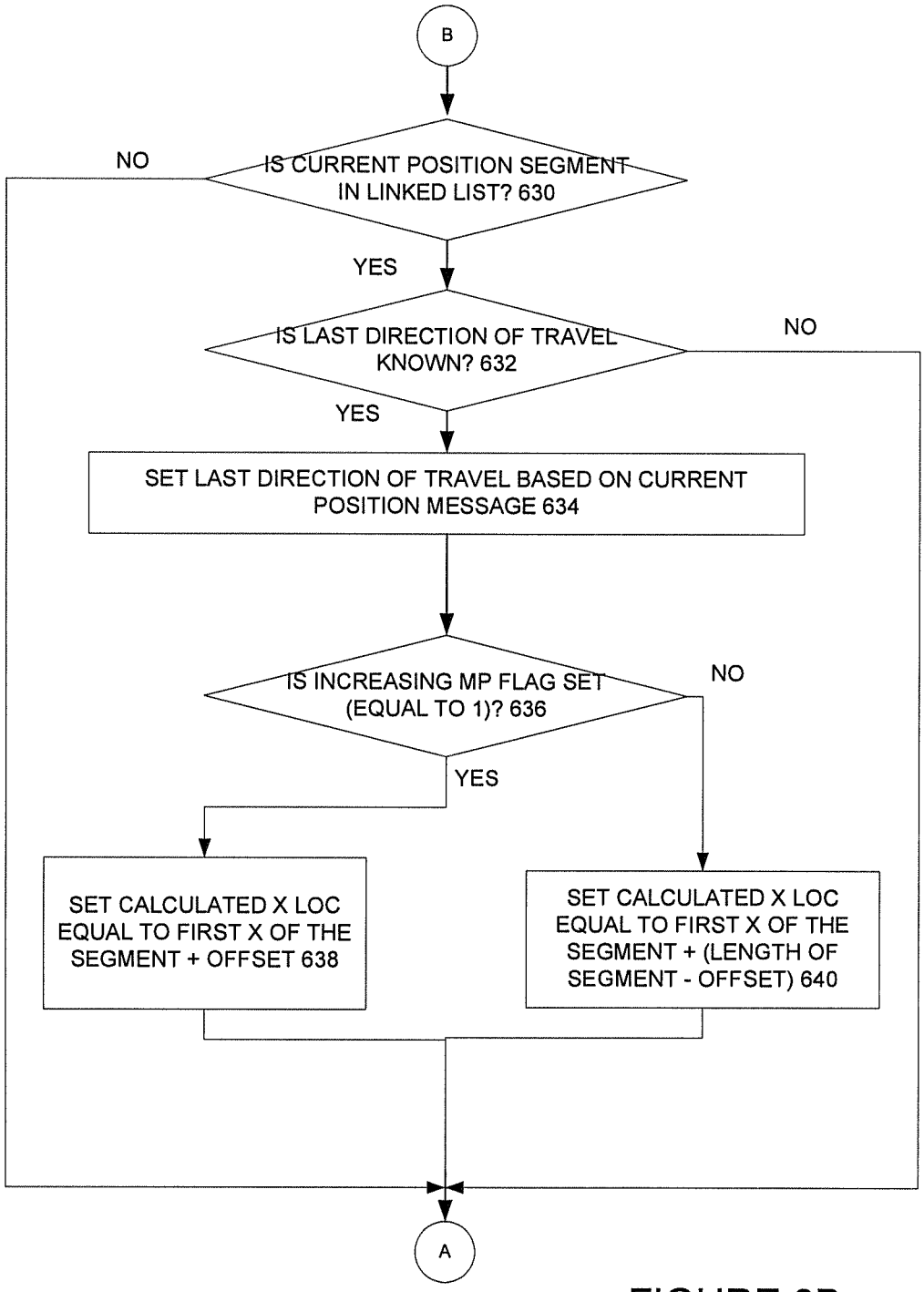
Figure 6C:
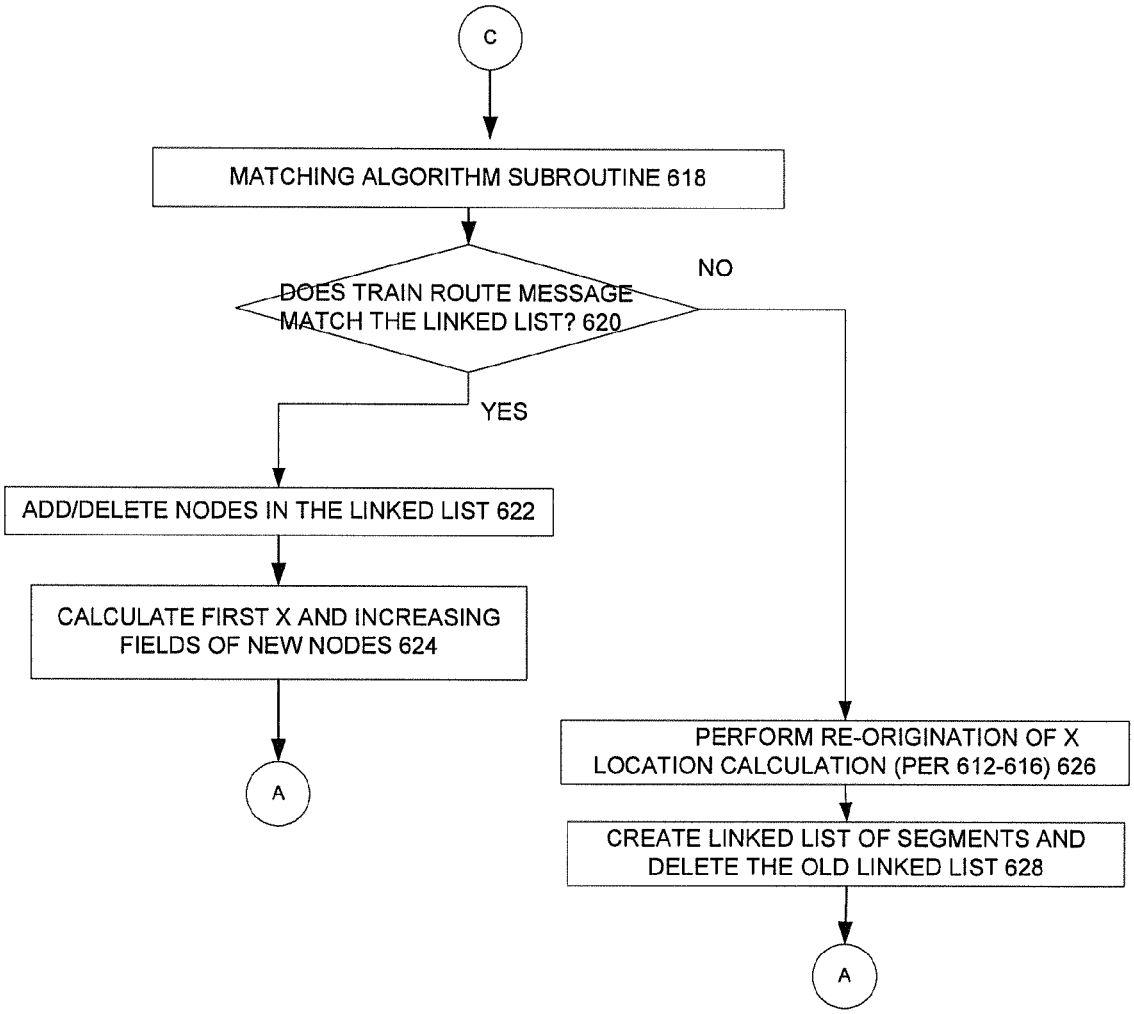
Figure 7:
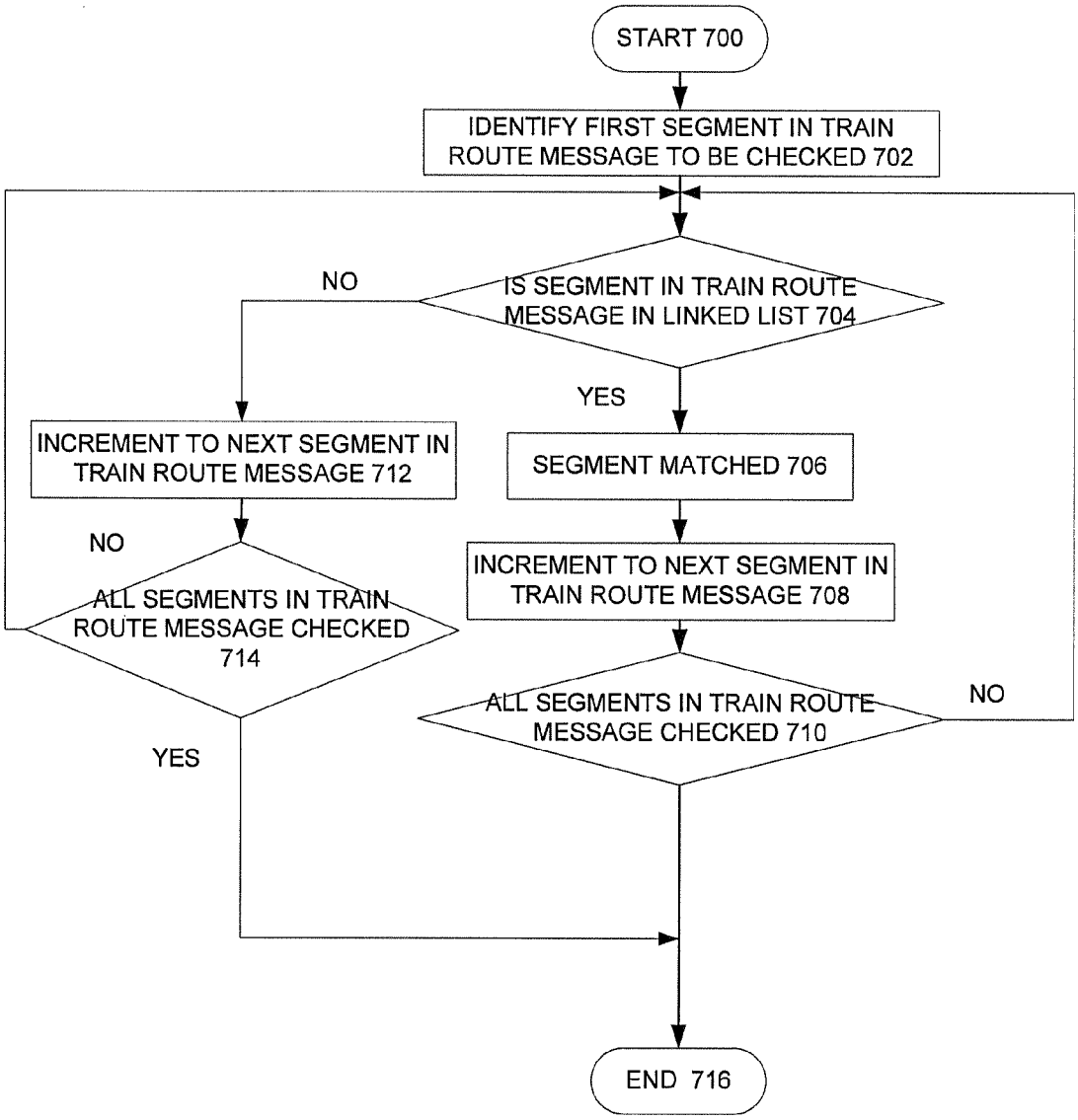
FIG. 7 illustrates one example of a methodology used for determining matching between segments in a Linked List and an incoming Train Route message.

Turning to the methodology for performing chainage distance calculation in accordance with the disclosed embodiments, FIGS. 6A-7 illustrate the various operations that are performed with at least one example.

As shown in FIG. 6A, operations begin at 600 and control proceeds to 602 at which initialization is performed by setting a pointer to data for the Linked List of Segments from a Train Route Message (such as that illustrated in FIG. 2) equal to null (0); additionally, the Last Direction of Travel from Current Position value is set equal to "unknown." Control then proceeds to 604, at which monitoring is performed for receipt of new train route and current position messages received by the train intelligence (i.e., conventionally known hardware and software associated with, for example, the PTC system module 105 and EMM module 110 (as illustrated in FIG. 1).

As shown in FIG. 6A, once it is determined whether a train route message is received at 606A, various method operations are performed. Likewise, once it is determined whether a current position message is received at 606B, various method operations are performed. It should be appreciated that the operations triggered by 606A and 606B may be performed simultaneously, or in any particular order that is recognized to be appropriate to one of ordinary skill in the art. Therefore, there is no requirement that operations performed based on the results of 606A be performed prior to operations performed based on the results of 606B.

If it is determined that a train route message has been received at 606A, control proceeds to 608, at which it is determined if the received train route message is the first train route message received after power up of the train intelligence. If so, control proceeds to 612, at which any old Linked Lists of track segments are deleted. Control then proceeds to 614, at which the first x of the first node is set equal to the middle of the 32 bit integer range for each subsequent node of the Linked List. Control then returns to 604 for monitoring of newly receive train route and current position messages. Likewise, if at 606A it is determined that no new train route message is received, control continues to 604 to perform continued monitoring.

If it is determined at 608 that the received train rout message is not the first train route message to be received after power up of the train intelligence, control proceeds to 610 at which it is determined whether the last direction of travel from the current position is unknown. If so, control proceeds to 612; however, if the last direction of travel from the current position is known, control proceeds to the operations shown in FIG. 6C.

More specifically, control proceeds to 618, at which a matching algorithm subroutine (explained herein with relation to FIG. 7) is performed. Based on the results of that matching algorithm subroutine, it is determined at 620 whether the train route message includes any matches to the Linked List. If so, control proceeds to 622, at which nodes of the Linked List are added or deleted based on the results of the matching algorithm. Subsequently, at 624, the first chainage distance is calculated and the value of the increasing fields is calculated for any newly added nodes. Control then returns to 604 (as shown in FIG. 6A) to monitor for receipt of new train route and current position messages)

If it is determined that the train route message does not include any matches to the Linked List at 620, control proceeds to 626 at which the operations performed to re-originate the X location are performed (per operations 612-616 illustrated in FIG. 6A). Subsequently, at 628, the old Linked List is deleted and a new Linked List is created. Control then returns to 604 (as shown in FIG. 6A) to monitor for receipt of new train route and current position messages.

Returning to the operations illustrated in FIG. 6A, if it is determined at 606B that a current position message has been received, control proceeds to the operations performed in FIG. 6B. As shown in that figure, control proceeds to 630, at which it is determined whether a current position segment is in the Linked List 630. If so control proceeds to 632, at which it is determined whether the last direction of travel is known. If so control proceeds to 634, at which the last direction of travel is set based on current position message.

Subsequently, control proceeds to 636, at which it is determined whether the increasing MP flag is set (i.e., equal to 1) in the received current position message. If it is, control proceeds to 638, at which the calculated chainage (X location) is set equal to the first x of the segment plus an Offset into Track Segment field of the received current position message. If it is not, control proceeds to 640, at which the calculated chainage (X location) is set equal to the first x of the segment plus the length of the segment minus the offset; this is because the Increasing MP flag=0 indicates that the offset is from end of the segment. From operations performed at either 638 or 640, control returns to 604 (as shown in FIG. 6A) to monitor for receipt of new train route and current position messages.

Likewise, if, at 632, it is determined that the last direction of travel is not known control returns to 604 to monitor for receipt of new train route and current position messages. Similarly, if, at 630, it is determined that the current position segment is not in the Linked List, control returns to 604.

Turning to the matching algorithm subroutine 618 illustrated in FIG. 6C, the operations of that subroutine are illustrated in FIG. 7 in greater detail. The matching algorithm is configured to determine if a received Train Route Message matches the existing Linked List of segments some portion or all of the existing Linked List of segments.

As shown in FIG. 7, the subroutine begins with the identification of a first segment in a train route message to be checked 702. This train route message is the train route message received and detected at 606A illustrated in FIG. 6A. Control then proceeds to 704, at which it is determined whether that segment in the train route message is in the current Linked List. If so, control proceeds to 706, at which the segment is designated as a matched segment and control proceeds to 708. At 708, the algorithm increments control to the next segment in the Train Route message. Control then proceeds to 710, at which it is determined whether all segments in the Train Route message have been checked. If not, control returns to 704, at which the next segment in the Train Route message is checked.

If so, the matching algorithm subroutine ends at 716 at which point, control proceeds to a determination of whether the received train route message includes matches to the Linked List (as 620 illustrated in FIG. 6C)

If, at 704, it is determined that the segment presently being analyzed in the Train Route message is not in the Linked List, control proceeds to 712, at which the algorithm increments control to the next segment in the Train Route message. Control then proceeds to 714, at which it is determined whether all segments in the Train Route message is checked. If so, control returns to 704. If not, control proceeds to 716 (as described above).

The attached Appendix includes an example of a software code implementation of the methodology described above in connection with FIG. 7. Therefore, it should be appreciated that the software code implementation of the matching algorithm subroutine is just one example of how the matching functionality may be performed.

Based on the results of the matching algorithm illustrated in FIG. 7, it is determined if and to what extent the Train Rout message matches the Linked List at 620.

To better understand the utility of the disclosed embodiments, various scenarios will now be explained. When a received Train Route message is considered to be matching with the existing Linked List, re-origination of X location calculation is not needed because the existing, or current Linked List need not be updated by new information or data included in the newly received Train Route message. As part of the analysis of the newly received Train Route message, each segment in the existing Linked List and the newly received Train Route message are annotated as (Segment ID, Increasing MP). For simplicity, the Increasing MP field may be set to 1, but it can be 0 as well.

In a first example, the existing Linked List may be (S1,1)→(S2,1)→(S3,1); the received Train Route is (S1,1), (S2,1), (S3,1). In such a situation, the updated Linked List is (S1,1)→(S2,1)→(S3,1). This is a result of the recognition that the Linked List and the Received Train Route message are identical. Therefore, the received Train Rout message and the existing Linked List are considered matching. Thus, there is no need to perform re-origination of X location calculation. Likewise, in a second example, the existing Linked List may be (S1,1)→(S2,1)→(S3,1); however, the received Train Route message is (S3,0), (S2,0), (S1,0). In such a situation, there is no matching whatsoever between the Linked List and the received Train Route message segments. In such a situation, the algorithm simply may revert back to maintaining the existing Linked List of (S1,1)→(S2,1)→(S3,1) because the content of the Train Route message provides insufficient data that would enable updating the existing Linked List. Another way of looking at this is that the Linked List need not be changed in this situation because Segments listed in the Train route message are in the correct order (S1, S2, S3) and (S3, S2, S1) but are indicating the opposite direction of travel (ascending segments versus descending segments). Thus, the Linked List, which pertains to ordering of segments only, need not be updated.

In a different set of scenarios, the Linked List may not change at all even though the train route has completely flipped the order of the segments.

Thus, in a third example, an existing Linked List may be (S1,1)→(S2,1)→(S3,1)→(S4,1)→(S5,1) and the received Train Route message may be (S2,1), (S3,1), (S4,1). In such a situation, the updated Linked List is (S2,1)→(S3,1)→(S4,1) because the front and back segments are deleted from the Linked List as not matching.

In a fourth example, an existing Linked List may be (S1,1)→(S2,1)→(S3,1), whereas a received Train Route message is (S1,1), (S2,1), (S3,1), (S4,1), (S5,1). In that situation, the newly received segments in the Train Route message may be added to the updated Linked List as (S1,1)→(S2,1)→(S3,1)→ (S4,1)→(S5,1).

In a fifth example, the existing Linked List may be (S1,1)→(S2,1)→(S3,1) while the received Train Route message is (S5,0), (S4,0), (S3,0), (S2,0), (S1,0). In such a situation, the updated Linked List may be (S1,1)→(S2,1)→(S3,1)→(S4,1) →(S5,1). Such a situation may occur when a locomotive train has flipped around and is now going backward and new segments have been added.

In a sixth example, an added node may have reversed the original Increasing MP field. In such a situation, an existing Linked List may be (S1,1)→(S2,1)→(S3,1)→(S4,1)→(S5,1) while the incoming Train Route message is (S2,1), (S3,1), (S4,1), (S5,1), (S6,1). As a result, the updated Linked List may be (S2,1)→(S3,1)→(S4,1)→(S5,1)→(S6,1).

It should be appreciated that, from time to time, a locomotive train may lose communication with a PTC network for sometime. As a result, when the train intelligence gets the communication link up, the EMM may receive a completely new set of segments in the Train Route message in which case re-origination of X location calculation is needed. Further, in some cases, the train may be switching to another segment different from a previously received Train Route message. In those cases, a new Train Route message will be received and the X location calculation will be re-originated.

It should also be appreciated that a received Train Route message is considered NOT to be matching with the existing Linked List. In such a situation, re-origination of X location calculation is needed.

For example, in a seventh example, when an existing Linked List is (S1,1)→(S2,1)→(S3,1)→(S4,1)→(S5,1) but a received Train Route message is (S1,1), (S7,1), (S3,1), (S4,1), (S5,1), no match may be found. In that example, one of the middle segments in the received Train Route message is different than that of the existing Linked List.

In an eighth example, an Linked List is (S1,1)→(S2,1)→(S3,1)→(S4,1)→(S5,1) but the received Train Route message is (S1,1), (S2,1), (S3,1), (S4,1), (S6,1) In such a situation, the last segment of the train route is different than that of the existing Linked List. As a result, re-origination of the X location is required.

In a ninth example, the existing Linked List is (S1,1)→(S2,1)→(S3,1)→(S4,1)→(S5,1) while the received Train Route message is (S1,1), (S2,0), (S3,1), (S4,1), (S5,1). In such a situation one of the segments in the train route has a different "Increasing MP" field from that of same segment in the Linked List. Such a difference is sufficient to warrant re-origination of the X location.

In a tenth example, the existing Linked List is (S1,1)→(S2,1)→(S3,1)→(S4,1)→(S5,1) while the received Train Route message is (S6,1), (S7,1), (S8,1), (S9,1), (S10,1). In such a situation, a complete different set of segments are received in the train route message. Accordingly, re-origination of the X location is warranted.

It should be understood that the chainage, i.e., X location, may be determined in accordance with above-described embodiments in a manner that efficiently utilizes messages routinely output by PTC systems.

Moreover, it should be understood that various connections are set forth between elements in the following description; however, these connections in general, and, unless otherwise specified, may be either direct or indirect, either permanent or transitory, and either dedicated or shared, and that this specification is not intended to be limiting in this respect.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

Various components of the invention may be provided in alternative combinations operated by, under the control of or on the behalf of various different entities or individuals.

Further, it should be understood that, in accordance with at least one embodiment of the invention, system components may be implemented together or separately and there may be one or more of any or all of the disclosed system components. Further, system components may be either dedicated systems or such functionality may be implemented as virtual systems implemented on general purpose equipment via software implementations.

As a result, it will be apparent for those skilled in the art that the illustrative embodiments described are only examples and that various modifications can be made within the scope of the invention as defined in the appended claims.

APPENDIX

MATCHING ALGORITHM EXAMPLE

```
match state = INIT
match flag = TRUE
temp Linked List = NULL
for (i = 0; (i < segment count in TR) AND (match flag); i++)
{
  Read next segment from Train Route message.
  switch (match state)
  {
    INIT:
    if (next segment of TR is in Linked List)
        match state = NEXT_SEG_MATCHED
        if (Increasing MP of TR matches that of found Linked List node)
```

APPENDIX-continued

MATCHING ALGORITHM EXAMPLE

```
                traverse direction in the Linked List = FORWARD
                Delete nodes backward after the found Linked List node
            else
                traverse direction in the Linked List = BACKWARD
                Delete nodes forward after the found Linked List node
        else
            match state = NEXT_SEG_NOT_IN_LIST
            Add this next segment to the temp Linked so that it can be added
main Linked List later
        NEXT_SEG_MATCHED:
        if next/prev segment of Linked List (based on traverse direction) =
        NULL
            Add the next segment of TR to the Linked List after/before the
found Linked List node
        else
            if (next segment of TR != next/prev segment of Linked List)
                //match state = NEXT_SEG_MISMATCHED
                match flag = FALSE //exit the state machine
            else
                if (this next segment of TR is the last segment of TR)
                    //match state = ALL_SEG_MATCHED
                    //match flag = TRUE
                    Delete nodes forward/backward after the found Linked
List node(if any)
        NEXT_SEG_NOT_IN_LIST:
        if (next segment in TR is in Linked List)
            match state = NEXT_SEG_MATCHED
            if (Increasing MP of TR matches that of found Linked List node)
                traverse direction in the Linked List = FORWARD
                if (backward node present in the Linked List) AND (temp
Linked List NOT NULL)
                    match flag = FALSE //exit the state machine
                else
                    Delete nodes backward after the found Linked List
                    node
                    Add temp Linked List to the main Linked List
            else
                traverse direction in the Linked List = BACKWARD
                if (forward node present in the Linked List) AND (temp
Linked List Not NULL)
                    match flag = FALSE //exit the state machine
                else
                    Delete nodes forward after the found Linked List
                    node
                    Add temp Linked List to the main Linked List
        else
            Add next segment of TR to temp Linked List so that it can be
added to main Linked List later
            if (this next segment of TR is the last segment of TR)
                //match state = ALL_SEG_NOT_IN_LIST
                match flag = FALSE //exit the state machine
    }
```

What is claimed is:

1. A chainage calculation system for calculating the chainage distance using Positive Train Control (PTC) messages, the system receiving a PTC Current Position message and a PTC Train Route message, wherein the PTC Current Position message provides an absolute position of the train head end in relation to both a stored track database and the PTC Train Route message, wherein the PTC Train Route message includes a track segment ID field, and wherein the messages are wirelessly received on board a locomotive, wherein the system utilizes data included in the received PTC Current Position message to determine a last direction of travel for the train when such data is available and compares an existing linked list with data received in the PTC Train Route message to determine whether the PTC Train Route message includes any matches to the linked list if it is determined that the received PTC Train Route message is not a first PTC Train Route message received and a last direction of travel for the train is not known, wherein each node of the existing linked list includes a track segment ID field, wherein the system adds or deletes nodes of the existing linked list based on the comparison of the existing linked list with the data received in the PTC Train Route message to produce an updated linked list and deletes a linked list and calculates an updated linked list if the received PTC Train Route message is the first PTC Train Route message received, the PTC Train Route message is not the first PTC Train Route message but the last direction of travel for the train is known, or it is determined that the Train Route message does not include any matches to the existing linked list, wherein the chainage distance is re-calculated based on the comparison of the existing linked list with the data received in the PTC Train Route Message if an updated linked list is calculated, wherein the chainage distance calculation is optionally omitted based on the comparison, and wherein the system is implemented in at least one computer processing unit coupled to a memory that stores computer instructions for controlling operations of the at least one computer processing unit to perform operations for calculating the chainage distance.

2. The system of claim 1, wherein the comparison of whether the PTC Train Route message includes matches to the existing linked list determines if the PTC Train Route Message matches some portion or all of the existing linked list of segments.

3. The system of claim 1, wherein the the comparison of whether the PTC Train Route message determines whether a current segment in the PTC Train Route message is in the existing linked list of segments, designates the current segment accordingly and increments to a next segment in the PTC Train Route message to be checked if any.

4. The system of claim 1, wherein, when it is determined that the existing linked list and the PTC Train Route message are identical, the PTC Train Route message and the existing linked list are considered matching and recalculation of the chainage distance is omitted.

5. The system of claim 1, wherein, when it is determined that the existing linked list and the PTC Train Route message are not matching, re-calculation of the chainage distance is omitted.

6. The system of claim 1, wherein the system receives the PTC Current Position and PTC Train Route message from a Positive Train Control (PTC) system.

7. The system of claim 6, wherein the PTC system is located on the train and receives information about the train location and where the train is allowed to travel from off-board the train.

8. The system of claim 1, wherein the system analyzes the PTC Current Position message to determine an absolute position of a head end of the train.

9. The system of claim 1, wherein the system re-calculates the chainage distance in response to receipt of the PTC Train Route message based on analysis of the data of the PTC Train Route message in comparison with a linked list of track segments.

10. The system of claim 1, wherein the existing linked list includes segments associated with track segments along a train's route, wherein for each segment, a chainage distance is associated with a beginning of the track segment.

11. The system of claim 1, wherein the calculated chainage distance is utilized to increase fuel efficiency and/or to perform locomotive diagnostics for train maintenance.

12. The system of claim 1, wherein energy management behavior of the train is modeled and managed using the calculated chainage distance.

13. A method for calculating the chainage distance, the method comprising:

receiving a PTC Current Position message and a PTC Train Route message, wherein the PTC Current Position message provides an absolute position of the train head end in relation to both a stored track database and the PTC Train Route message, wherein the PTC Train Route message includes a track segment ID field, and wherein the PTC Current Position message and the Train Route message are received wirelessly on board a locomotive;

utilizing data included in the received PTC Current Position message to determine a last direction of travel for the train when such data is available;

comparing an existing linked list with data received in the PTC Train Route message to determine whether the PTC Train Route message includes any matches to the linked list if it is determined that the received PTC Train Route message is not a first PTC Train Route message received and a last direction of travel for the train is not known;

adding or deleting nodes of the existing linked list based on the comparison of the existing linked list with the data received in the PTC Train Route message to produce an updated linked list;

deleting a linked list and calculating an updated linked list if the received PTC Train Route message is the first PTC Train Route message received, the PTC Train Route message is not the first PTC Train Route message but the last direction of travel for the train is known, or it is determined that the PTC Train Route message does not include any matches to the existing linked list, and re-calculating the chainage distance based on the determination performed by the comparison if an updated linked list is calculated, wherein the chainage distance calculation is optionally omitted based on the comparison.

14. The method of claim 13, wherein the comparison of whether the PTC Train Route message includes matches to the existing linked list determines if the PTC Train Route Message matches some portion or all of the existing linked list of segments.

15. The method of claim 13, wherein the comparison whether the PTC Train Route message determines whether a current segment in the PTC Train Route message is in the existing linked list of segments, designates the current segment accordingly and increments to a next segment in the PTC Train Route message to be checked if any.

16. The method of claim 13, wherein, when it is determined that the existing linked list and the PTC Train Route message are identical, the PTC Train Route message and the existing linked list are considered matching and re-calculation of the chainage distance is omitted.

17. The method of claim 13, wherein, when it is determined that the existing linked list and the PTC Train Route message are not matching, recalculation of the chainage distance is omitted.

18. The method of claim 13, further comprising receiving the PTC Current Position and PTC Train Route message receives such messages from a Positive Train Control (PTC) system.

19. The method of claim 18, wherein the PTC system is located on the train and receives information about the train location and where the train is allowed to travel from off-board the train.

20. The method of claim 13, further comprising analyzing the PTC Current Position message to determine an absolute position of a head end of the train.

21. The method of claim 13, wherein the calculation of the chainage distance performed in response to receipt of the PTC Train Route message is based on analysis of the data of the PTC Train Route message in comparison with a linked list of track segments.

22. The method of claim 13, wherein the existing linked list includes segments associated with track segments along a train's route, wherein for each segment, a chainage distance is associated with a beginning of the track segment.

23. The method of claim 13, wherein the calculated chainage distance is utilized to increase fuel efficiency and/or to perform locomotive diagnostics for train maintenance.

24. The method of claim 13, wherein energy management behavior of the train is modeled and managed using the calculated chainage distance.

* * * * *